United States Patent [19]

Sakai

[11] 3,946,466

[45] Mar. 30, 1976

[54] CLAMPING DEVICE FOR A PROTECTIVE DEVICE MOUNTED ON A SAFETY HEADGEAR

[76] Inventor: Yoshijiro Sakai, No. 35-65 Yamanishi,, Ninomiya, Naka, Kanagawa, Japan

[22] Filed: Sept. 12, 1974

[21] Appl. No.: 505,515

[52] U.S. Cl. ..... 24/243 B; 2/10

[51] Int. Cl.[2] ..... A44B 21/00; A41D 13/00

[58] Field of Search ..... 24/243 B, 243 D, DIG. 22, 24/73 VA, 248 PC, 263 A, 243 CC; 269/265, 268, 275; 2/10

[56] References Cited

UNITED STATES PATENTS

| | | | |
|---|---|---|---|
| 971,438 | 9/1910 | Gillitt | 24/263 A |
| 2,894,548 | 7/1959 | Peck et al. | 269/265 |
| 3,605,114 | 9/1971 | Hanlein et al. | 2/10 |

*Primary Examiner*—Donald A. Griffin

*Attorney, Agent, or Firm*—Oblon, Fisher, Spivak, McClelland & Maier

[57] ABSTRACT

A clamping device for a protective device mounted on a headgear comprising a clamp member connected to the protective device, a U-shaped receiving portion formed at the lower side of the clamp member for receiving the lower edge of the headgear, at least one clamp screw provided on the clamp member opposite to the receiving portion, a nose formed at the end of the clamp screw and enclosed with a convexly-curved surface, and a hollow presser loosely connected to said clamp screw and enclosing said nose.

3 Claims, 14 Drawing Figures

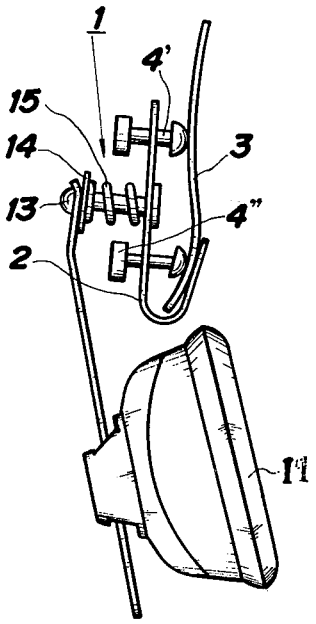
FIG. 5a
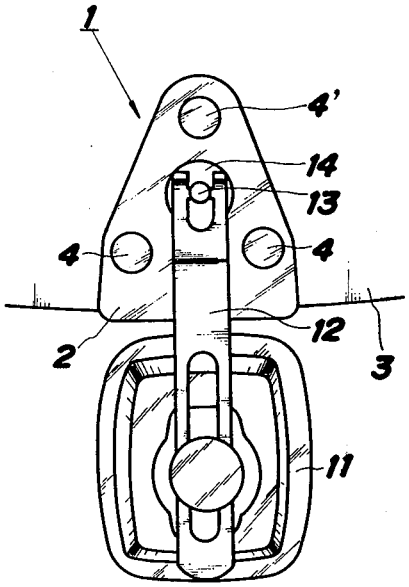
FIG. 5b
FIG. 6
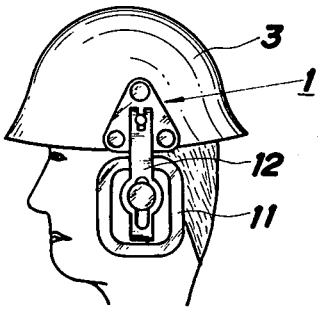
FIG. 7
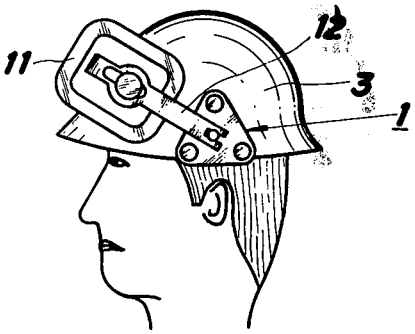

FIG. 8a
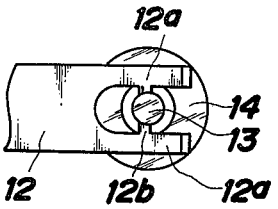
FIG. 9a
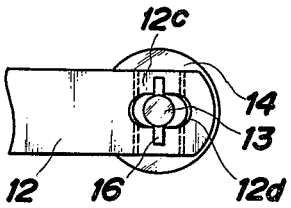
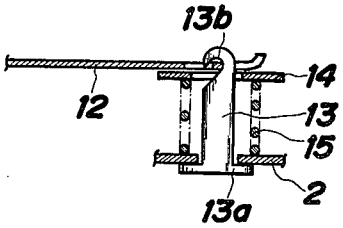
FIG. 8b
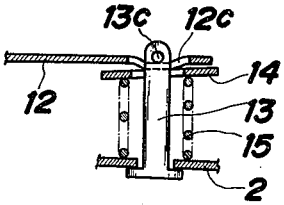
FIG. 9b
FIG. 10
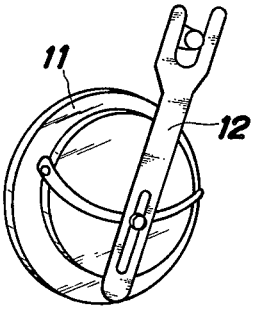
FIG. 11
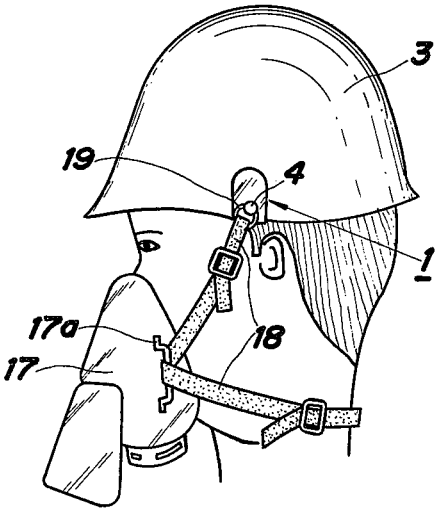

CLAMPING DEVICE FOR A PROTECTIVE DEVICE MOUNTED ON A SAFETY HEADGEAR

This invention relates to a clamping device for a protective device mounted on a safety headgear.

Conventional clamping devices for accessories of a safety headgear, e.g., masks, face-guards, earmuffs, etc. heretofore proposed are mainly of the type which comprises a clamp member whose lower side is bent into a U-shaped receiving portion for receiving the lower edge of a headgear, a clamp screw provided on the clamp member near its lower side, the leading end of said clamp screw being opposite to said receiving portion, and said clamp member being connected at its upper end to an accessory. The conventional clamping device of this type can fix the lower end of a safety headgear by the clamp screw, however, it has a disadvantage that the clamp screw once tightened tends to loosen because the curved surface of the headgear at its lower end varies depending upon its maker and, in addition, the loosened screw must be re-tightened during operation with much trouble.

In recent years, a harmful environment is not simple and is formed of many factors intertwined. Therefore, in such a harmful environment, an operator is required to wear two or more protective devices in many cases. Accordingly, a plurality of protective devices are required to be mounted in a narrow area easily and organically without deteriorating their respective functions, especially in the case of head (in a wide sense) protecting devices. For this reason, many kinds of protective devices heretofore mainly produced independently of each other and which must be mounted on a human body independently of each other cannot cope with the above-mentioned situation. It is desirable that the protective devices to be mounted should be connected to each other organically with ease and without deteriorating their respective functions.

It is, therefore, an object of the present invention to provide a clamping device for protective devices mounted on a headgear which can connect and fix the protective devices to the headgear without tendency to loosen.

It is another object of the present invention to provide a clamping device for protective devices mounted on a headgear which can connect and fix the protective devices to the headgear easily, organically and without deteriorating their respective functions.

According to the present invention, there is provided a clamping device for protective devices mounted on a headgear comprising a clamp member, a U-shaped receiving portion formed at the lower side of said clamp member for receiving the lower edge of the headgear, at least one clamp screw provided on said clamp member opposite to said receiving portion, a nose formed at the end of said clamp screw and enclosed with a convexly-curved surface, and a hollow presser loosely connected to said clamp screw and enclosing said nose.

According to another aspect of the present invention, said nose of the clamp screw is enclosed with a spherical surface.

According to still another aspect of the present invention, said hollow presser has a tray-like surface for coming into contact with the lower edge of the headgear.

Other objects, features and advantages of the present invention will be more apparent from the following description taken in conjunction with the accompanying drawings wherein.

FIGS. 5*a* and 5*b* are schematical side and elevational views, respectively, of an earmuff connected to a clamping device according to the present invention;

FIG. 6 is a sketch view of an earmuff connected to a headgear through a clamping device according to the present invention, showing its condition in use;

FIG. 7 is a sketch view similar to FIG. 6, but showing its condition not in use;

FIGS. 8*a* and 8*b* are schematical plan and side views, respectively, of the connection between an earmuff arm and a clamping device according to the present invention;

FIGS. 9*a* and 9*b* are schematical plan and side views, respectively similar to FIG. 8, but showing another embodiment of the connection;

FIG. 10 is a sketch view of the connection between an earmuff of a different type and a clamping device of the present invention through an earmuff arm; and FIG. 11 is a half-face mask in use connected to a headgear through rubber straps and a clamping device according to the present invention.

Figure 1:
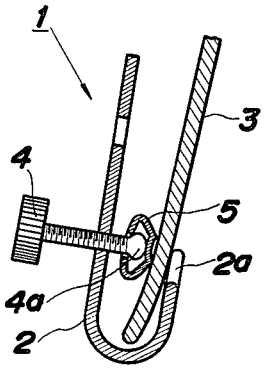
FIG. 1 is a schematical sectional view of a clamping device according to the present invention.
Figure 2:
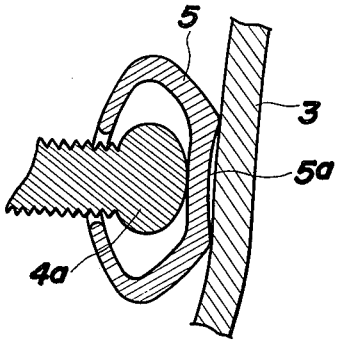
FIG. 2 is an enlarged sectional view of a clamping device according to the present invention, showing its clamp screw and presser loosely connected to each other.

Now referring to FIG. 1, Numeral 1 designates a clamping device of accessories for a safety headgear according to the present invention. It has a clamp member 2 whose lower side is bent into a U-shape to form a receiving portion 2*a* so that the edge of a safety headgear 3 may be well fitted therein. The clamp member 2 also has a clamp screw 4 at a suitable position of its lower side so that its nose 4*a* may be positioned opposite to the receiving portion 2*a* of the clamp member 2. A hollow presser 5 is loosely fitted to the nose 4*a* of the clamp screw 4. As shown in FIG. 1 and FIG. 2, the presser 5 has a cavity therein sufficient to ensure a suitable clearance between the inside wall of the presser 5 and the nose 4*a* of the clamp screw 4. The nose 4*a* of the clamp screw 4, which comes into contact with the presser 5, has a spherical or convexly-curved surface so that, when the clamp screw 4 is tightened, it may well maintain contact with the presser 5 without loosening even if the presser 5 assumes any position depending upon the curved or flat surface of the headgear 3.

As shown in FIG. 2, which is an enlarged view of the nose portion 4*a* of the clamp screw 4 and the presser 5 showing how they are loosely connected, the presser 5 is provided with a tray-like recess 5*a* at the portion where it comes into contact with the headgear 3. Therefore, when the clamping device 1 is fitted to the headgear 3, the presser 5 can come into contact with the headgear 3 at two points at least and at all the points of the tray-like recess circumference at the maximum, even if the headgear 3 is formed of any possible curved surface. Compared with one point contact in the case of a conventional device in which the aforementioned contact surface between the presser and the headgear assumes a flat or curved surface, the device according to the present invention has a large frictional resistance between the presser and the headgear for the above-mentioned reason and, therefore, has little tendency to slip off the headgear.

With the above-mentioned construction, the device according to the present invention can be fitted to almost all the types of headgears.

Figure 3:
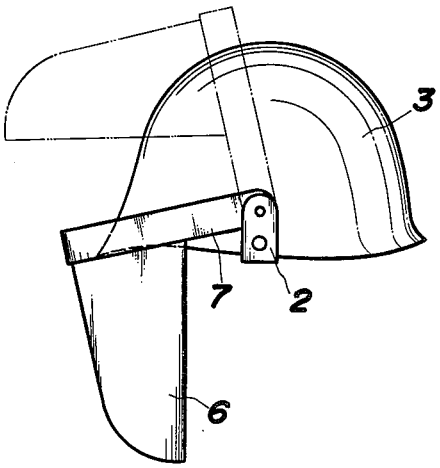
FIG. 3 is a sketch view of a safety headgear and a face-guard connected to each other by a clamping device according to the present invention.
Figure 4:
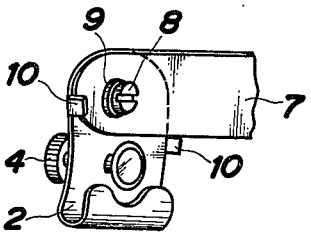
FIG. 4 is a sketch view of a clamping device connected to an arm of a protective device, showing stoppers provided on the clamping device.

FIG. 3 is a schematical view of a face-guard and a safety headgear connected by a device according to the present invention. A face-guard 6 is provided with a pair of arms 7 each of which is connected to a device of the present invention through screws 8 and nuts. Thus the face-guard 6 is fitted to the headgear 3 through the arms 7. and the devices according to the present invention. Since the condition of connection between the face-guard 6, i.e., the arms 7 and the headgear 3 can be adjusted by the tightening conditions of spring washers 9 and screws 8 therebetween, the face-guard 6 can be rotated up and down about the screws 8 and, in addition, can be stopped at any position within the range of its rotation. If stoppers 10 are provided on the clamp member 2 as shown in FIG. 4, the rotation range of the face-guard 6 can be restricted therebetween.

FIG. 5 is side and elevational views of an earmuff 11 and a headgear 3 connected to each other by a clamping device 1 according to the present invention. In this embodiment, the device 1 is provided with a plurality of clamp screws 4 (one holding screw 4'' and two tightening screws 4''), pressers, etc. The holding screw 4', which has the same shape as that of the tightening screw 4'', is useful for stabilizing the connection between the earmuff 11 and the headgear 3. FIG. 6 is a schematical view of an earmuff fitted to a headgear, showing its condition in use. The earmuff 11 is rotatably connected to the clamping device 1 through an arm 12, a shaft 13, a stabilizing plate 14 and a spring 15. With the abovementioned construction, the earmuff 11 is adapted to be able to rotate about the shaft 13 and, in addition, about an axis at a right angle to the shaft 13. Therefore, the earmuff 11 connected to a headgear by a clamping device according to the present invention does not deteriorate its function and, moreover, can be conveniently held at the top of the headgear 3 as shown in FIG. 7 when it is not in use. FIG. 8 and 9 are side views and plan views showing two kinds of connections between the device of the present invention and the earmuff arm 12, respectively. In FIG. 8, the earmuff arm 12 has at its one end a pair of sub-arms 12*a* between which a beam 12*b* is provided. The end of the sub-arm 12*a* is externally bent. A shaft 13 with a head 13*a* is inserted through a hole of the clamp member 2. The shaft 13 is fitted with a compression spring 15 and a stabilizing plate 14 therearound, and it has a notch 13*b* at its upper end for receiving the beam 12*b* of the earmuff arm 12. Thus the compression spring 15 urges the stabilizing plate 14 and the earmuff arm 12 at all times upwardly. With the above-mentioned construction, the earmuff arm 12 can be rotated about the shaft 13 together therewith and, in addition, can be rotated about the beam 12*b*. The embodiment shown in FIG. 9 is almost the same as that shown in FIG. 8, but the earmuff arm 12 has an internally curved portion 12*c* near its end and the shaft 13 has near its end a hole 13*c* into which a pin 16 is to be press-fitted. The earmuff arm 12 is provided with an elongated hole 12*d* at its curved portion 12*c*. The shaft 13 is inserted in the elongated hole 12*d* whose short diameter is larger than the diameter of the shaft 13, and the pin 16 is press-fitted into the hole 13*c* so that the pin 16 may be positioned along the curved portion 12*c* of the earmuff arm 12. Thus the earmuff arm 12 in this embodiment can be operated in the same manner as that in the embodiment shown in FIG. 8. Of course, embodiments other than the above-mentioned are possible.

FIG. 10 is a sketch view of another example of the connection between an earmuff and the device according to the present invention.

FIG. 11 shows a sketch view of one example of the connection between a half-face mask and the device according to the present invention. In this example, a half-face mask 17 is held in position by the use of rubber straps 18. One of the rubber straps 18 is provided at its one end with a fitting 19 or the like suitably connected to a clamp screw 4 of the clamping device 1 according to the present invention, and it passes through a strap holder 17*a* mounted on the half-face mask 17 and is connected to the other of the rubber straps 18 extending from the other side of the half-face mask 17 around the wearer's neck. Thus the half-face mask 17 can be mounted with great stability.

As is apparent from the foregoing description, though protective devices must be independently fitted to a human body in the past, the clamping device according to the present invention can fit protective devices to a headgear organically and, in addition, only by tightening a screw or screws. Therefore, the mounting operation can be carried out very easily and without preliminary knowledges and any troubles.

What is claimed is:

1. A clamping device for a protective device mounted on a headgear comprising:

a clamp member connected to said protective device and having an upper and lower portion;

a U-shaped receiving portion formed at the lower side of said clamp member for receiving the lower edge of said headgear;

at least one clamp screw provided on said clamp member opposite to said receiving portion so as to clamp said lower edge of said headgear between said at least one clamp screw and said receiving portion;

pivot means disposed upon said clamp member for pivotably supporting said protective device upon said headgear;

at least one additional clamp screw provided upon said clamp member within said upper portion of said clamp member and above said pivot means for abutting said headgear and thereby stabilizing the clamped connection established between said protective device and said headgear by means of said at least one clamp screw and said receiving portion;

a nose formed at the end of each of said clamp screws and enclosed with a convexly curved surface; and a hollow presser loosely connected to each of said clamp screws and enclosing said nose portions.

2. A clamping device for a protective device mounted on a headgear as set forth in claim 1, wherein said nose portions of the clamp screws are enclosed with spherical surfaces.

3. A clamping device for a protective device mounted on a headgear as set forth in claim 1, wherein each of said hollow pressers has a tray-like recess for coming into contact with the lower edge of said headgear.

* * * * *